US005426299A

United States Patent [19]

Nakagawa et al.

[11] Patent Number: 5,426,299

[45] Date of Patent: Jun. 20, 1995

[54] INDUCTIVE PLASMA MASS SPECTROMETER

[75] Inventors: Yoshitomo Nakagawa; Tetsumasa Itoh, both of Tokyo, Japan

[73] Assignee: Seiko Instruments Inc., Tokyo, Japan

[21] Appl. No.: 208,009

[22] Filed: Mar. 9, 1994

[30] Foreign Application Priority Data

Mar. 9, 1993 [JP] Japan ..... 5-048400

[51] Int. Cl.[6] ..... H01J 49/26

[52] U.S. Cl. ..... 250/281; 250/283; 250/286; 250/299; 250/300; 250/397

[58] Field of Search ..... 250/281, 282, 283, 286, 250/299, 300, 397

[56] References Cited

U.S. PATENT DOCUMENTS 5,202,562 4/1993 Koga et al. ..... 250/282

*Primary Examiner*—Paul M. Dzierzynski
*Assistant Examiner*—Kiet T. Nguyen
*Attorney, Agent, or Firm*—Spensley Horn Jubas & Lubitz

[57] ABSTRACT

An object of the present invention is to provide a detection system wherein ion counting is performed by varying the quantity of the ions incident on a detector 13 of an inductive plasma mass spectrometer depending on the concentration of the impurities to be measured, thereby extending the life of the detector 13, expanding the range for measurement of impurities in high concentrations, and reducing costs. An assist electrode 30 having a hole for leading the ions which have passed through a mass filter 10 to a detector 30 is disposed between the axis of the mass filter 10 and the detector 13, and a means for applying voltage to a repeller electrode 12 and the assist electrode 30 is provided to vary the difference in voltage between the electrodes 12 and 30 depending on the concentration of impurities to be measured. When the concentration of the impurities to be measured is high, the difference in electric potential between the repeller electrode 12 and the assist electrode 30 is made greater than the difference in electric potential set for measurement at low concentrations. The life of the detector is extended, high impurity concentrations of up to six digits can be measured, and an inexpensive detection system is provided.

5 Claims, 4 Drawing Sheets

INDUCTIVE PLASMA MASS SPECTROMETER

BACKGROUND OF THE INVENTION

The present invention relates to an inductive plasma mass spectrometer which ionizes a sample with inductive plasma and detects the ions thus generated by mass-separating them using a mass filter to identify and quantify minor impurities in the sample.

Conventional inductive plasma mass spectrometers have a general configuration as shown in FIG. 2.

In FIG. 2, 1 designates a plasma torch; 2 designates an inductive coil; 3 designates inductive plasma. A plasma generating portion is constituted by the plasma torch 1, the inductive coil 2 and gas (e.g., Ar) flowing into the plasma torch 1. A liquid sample is normally nebulized by a nebulizer (not shown) and is supplied to the plasma torch 1 along with carrier gas. The inductive coil 2 is wound around the forward end of the plasma torch 1 and high frequency power of 27.12 MHz or 40 MHz is applied thereto. The inductive plasma 3 is maintained by being inductively coupled with this high frequency power. Such a plasma generating portion is referred to as inductively coupled plasma (ICP) while there are instances wherein a microwave inductive plasma (MIP) such as that disclosed in Japanese patent publication No. H03-95899 is used as a plasma generating portion.

4 designates a sampling cone. 5 designates a skimmer cone. 6 designates a vacuum chamber. 7, 8, and 9 designate pumps a, b, and c, respectively. The sampling cone 4 and the skimmer cone 5 are in the form of a cone and have round holes of diameters on the order of 0.9 to 1.2 mm and 0.3 to 0.6 mm, respectively. The sample which has been ionized in the inductive plasma 3 are introduced into the vacuum chamber 6 through the holes of the sampling cone 4 and the skimmer cone 5.

The vacuum chamber 6 is differentially evacuated by a pump 7, a pump 8, and a pump 9 to maintain vacuum therein. As to the types of the pumps, normally, a rotary pump is used as the pump and turbo-molecular pumps or oil diffusion pumps are used as the pumps b and c of 8 and 9, respectively.

Although not shown in the figure, auxiliary pumps are normally used for the pumps 8 and 9. The vacuum evacuator is constituted by the pumps 8 and 9 and the auxiliary pumps.

10 designates a mass filter. 11 designates an ion lens. 12 designates a repeller electrode. 13 designates a detector. The mass filter 10 allows ions having a mass corresponding to preset voltage to pass therethrough from among the ions incident thereon and a quadrupole mass spectrometer is normally used. The ion lens 11 efficiently causes the ions which have passed through the skimmer cone 5 to enter the mass filter 10 and to block the light from the plasma 3.

The ions which have passed through the mass filter 10 are detected by the detector 13. The CHANNEL TRON from GALILEO CORPORATION is normally used as the detector 13. The repeller electrode 12 leads the ions which have passed through the mass filter 10 to the ion detector 13. Positive voltage is applied when the ions are positive ions and negative voltage is applied when the ions are negative ions.

The mass number of impurities in the sample is obtained from the voltage applied to the mass filter 10 when they are detected by the detector 13. In other words, the impurities are identified. Further, the concentration of impurities can be obtained from the quantity of ions detected by the detector 13.

Next, the configuration from the exit of the mass filter 11 up to the detector 13 will now be described with reference to FIG. 3. In FIG. 3, 10 designates a mass filter; 12 designates a repeller electrode; 13 designates a detector; 14 designates an extraction electrode; 15 designates light; and 16 designates ions.

Ions which have reached the exit of the mass filter 10 are extracted from the mass filter 10 by the extraction electrode 14 and are accelerated. The repeller electrode 12 and the detector 13 are disposed opposite to each other about the central axis of the mass filter 10. This is to allow only the ions which have passed through the mass filter 10 to reach the detector 13.

Specifically, the ions 16 are led to the detector 13 by an electric field which is produced by electric potential applied to the repeller electrode 12 and electric potential applied to be detector 13 while the light 15 (which has not been blocked by the ion lens shown in FIG. 2) acting as a background noise is left traveling straight so that it will not reach the detector 13.

17 designates a negative high voltage power source. 18 designates a pulse pre-amplifier. 19 designates a discriminator.

20 designates a data processor. 21 designates an output terminal. When the ions detected are positive ions, a high voltage of about −2 to −2.5 KV is applied from the high voltage power source 17 to the forward end of the detector 13, the rear end thereof being grounded. The ions 16 incident on the detector 13 are charge-amplified by a factor of about 10 to 10 in the detector 13 and reach the output terminal 21 in the form of pulses.

The pulses at the output terminal 21 are amplified by the pulse pre-amplifier by a factor of about 10 to 100 and are sent to the discriminator 19. The pulses include noises. The discriminator 19 separates a ion signal from the noises according to the pulse height and sends only the ion signal to the data processor 20. The data processor 20 counts the pulses as the ion signal.

The mass, i.e., identification of the ions is performed according to the voltage at the mass filter 10 at the time of counting and the concentration of minor impurities is obtained from the quantity counted or the counting rate. When negative ions are detected, the polarities of the voltage applied to the repeller electrode 12 and the forward end of detector 13 are reversed. Description will be omitted in this regard because it is disclosed in, for example, an article "Channel electron murutipliers" in "Reprinted from American Laboratory, March, 1979.

According to such a detection method, the range of quantifiable concentrations of minor impurities is from about 1 ppq (1/10) to about 100 ppb (1/10). The reason is that if the flux of the ions incident on the detector 13 increases, electrification occurs in the vicinity of the output terminal inside the detector 13 due to emission of secondary electrons in a large amount, which results in a change in the distribution of electric potential to reduce the strength of the electrolyte, thereby suppressing amplification of subsequent signals. The method of quantifying minor impurities in a concentration of about 100 ppb (1/10) or more is known and will now be described with reference to FIG. 4.

In FIG. 4, the mass filter 10, the extraction electrode 14, and the repeller electrode 12 are similar to those previously described. **13*a* designates a detector. The detector 13*a*** has a structure wherein an analog anode 22, an isolation grid 23, and a protection grid 24 are provided in the middle of its body and an output terminal 21 is provided at the rear end thereof. When positive ions are detected, negative voltage is applied by the negative high voltage power source 17 to the forward end of the detector 13*a*; positive voltage is applied by a positive high voltage power source 28 to the rear portion; and 0 electric potential is applied to the protection grid 24.

In this detector 13*a*, the charge of incident ions is amplified to about 104 at the position of the analog anode 22 and to about 10 at the output terminal 21. 25 designates a pre-amplifier. 26 designates a VF converter. 27 designates a protection circuit. If the impurity concentration to be detected is about 100 ppb (1/10) or less (i.e., ion incidence of about 10 pulses per second or less), the charge of the ions is amplified up to the output terminal 21 and pulse-counted by the data processor 20 through the pulse pre-amplifier 18 and the discriminator 19 (Hereinafter, this is referred to as ion count method.).

When the impurity concentration to be detected is high [concentrations in the range of about 10 ppb (1/10) to 100 ppm (1/10)], the ions incident on the detector 13*a* are current-detected at the analog anode 22. The current flowing through the analog anode 22 is converted to voltage and amplified by the pre-amplifier 25 and is supplied to the VF converter 26. The VF converter 26 converts the voltage input by the pre-amplifier to pulses having a frequency proportionate thereto which are pulse-counted by the data processor 20*a* (Hereinafter, this is referred to as coulometric detection method.).

The data processor 20 determines whether to employ the ion count method or employ current detection method through management of the quantity of the input from the discriminator 19 or the VF converter 26 (counting rate). To perform the current detection, it sends a signal to the protection circuit 27 to protect the downstream of the detector 13*a* and applies voltage to the protection grid 24 to prevent secondary electrons from entering the downstream of the detector 13*a*. An inductive plasma mass spectrometer having such a configuration can measure concentrations of minor impurities in the range of about 1 ppq (1/10) to 100 ppm (1/10).

However, the prior art has the problems as follows. The first problem is the life of the detector in measuring impurities in high concentrations [concentrations on the ppm (1/10) order]. In the prior art, almost all of the ions which had passed through the mass filter 10 have always reached the detector. This is because the voltage applied to the detector 13 is 2 to 2.5 KV while the voltage applied to the repeller electrode 12 is on the order of several tens volts to 100 volts and, therefore, the electric field produced by the detector is very strong. The ions which have entered the detector stay on the inner wall of the detector, reducing the yield of the emission of secondary electrons. As a result, the life of the detector is shortened by measuring impurities in high concentrations.

The second problem originates from the current detection performed to detect impurities in high concentrations. The current detected is within a narrow range of effective figures in about four digits on the order of 1/10 to 1/10 A. For 1/10 A or more, the amplification performed by the detector is suppressed for the reason described above, and detection of very small current of 1/10 A or less suffers from reduction in accuracy (Measurement is disabled due to saturation.). Although the region of 1/10 A or less can be measured using the ion count, it is desirable as an analyzer to be capable of performing measurement at intermediate concentrations under the same conditions as for measurement at high concentrations.

The third problem is the cost. Compared to the configuration in FIG. 3, the prior art shown in FIG. 4 increases not only elements such as the pre-amplifier, VF converter, protection circuit, positive high voltage power source but also the price of the detector which is an expendable part.

The present invention has been conceived to solve the above-mentioned problems, and it is an object of the present invention to provide a detection system is an inductive plasma mass spectrometer wherein deterioration of the detector is suppressed, the range of concentrations which can be measured under the conditions for measurement at high concentrations is set to have effective figures in about six digits and which is inexpensive.

The above and other objects and novel features of the present invention will be apparent from the description in this specification and the accompanying drawings.

SUMMARY OF THE INVENTION

In order to achieve the above-mentioned object, the inductive plasma mass spectrometer according to the present invention is an inductive plasma mass spectrometer comprising a plasma generating portion for inductively converting a sample into plasma, a sampling cone and a skimmer cone having small holes on the forward ends thereof for introducing the sample which has been ionized by the plasma generating portion into a vacuum chamber, a mass filter which allows ions having a specified mass to pass therethrough from among ions of the sample, an ion lens for leading the ions of the sample which have passed through the skimmer cone to the mass filter, a detector for detecting the ions which have passed through the mass filter, a repeller electrode disposed at the exit of the mass filter on the side opposite to the detector about the central axis of the mass filter, and an evacuator for evacuating the mass filter, the ion lens, the detector and the repeller electrode in the vacuum chamber mainly characterized in that an assist electrode having a hole for leading ions of minor impurities in the sample which have passed through the mass filter to the detector is provided between the axis of the mass filter and the detector and a means for applying voltage to the repeller electrode and the assist electrode.

In the inductive plasma mass spectrometer having the configuration as described above, the assist electrode can suppress the effect that the ions which have passed through the mass filter are attracted by the detector due to an electric field produced by the detector. The quantity of the ions incident on the detector can be controlled by controlling the voltage applied to the repeller electrode or assist electrode. The voltage of the repeller electrode or assist electrode is set so that ions efficiently reach the detector during measurement of minor impurities in low concentrations and a part of ions which have passed through the detector reach the detector during measurement of minor impurities in high concentrations. This solves the problem with the prior art that the detector is deteriorated during measurement of impurities in high concentrations. Further, the present invention allows measurement in the concentration range in about six digits under the same conditions because the ion counting is performed even in the measurement of impurities in high concentrations. In addition, according to the present invention, ion detection is carried out using only the ion count method. It is therefore possible to provide a detection system less expensive compared with the prior art wherein the ion count method and the current detection method are used simultaneously.

On the other hand, the ions which have passed through the mass filter include ions acting as noises besides the ions of minor impurities in the sample to be detected. Since the ions acting as noises have energy which is closer to 0 than that of the ions to be detected, they are polarized by the electric field produced by the repeller electrode and the assist electrode more significantly than the ions to be detected. Therefore, when the concentration of the minor impurities to be detected is high, it is possible to reduce the quantity of the ions to be detected which reach the detector and perform measurement free from noises by making the difference in electric potential between the repeller electrode and the assist electrode greater than the difference in electric potential set during measurement at low concentrations (i.e., the quantity in which the ions are polarized is increased).

BRIEF DESCRIPTION OF DRAWINGS

These and other features, aspects and advantages of the present invention will become better understood with reference to the following description, claims and drawings, of which:

DETAILED DESCRIPTION

An embodiment of the present invention will now be described in detail with reference to the drawings. Throughout the drawings, parts having like functions are designated by like reference numbers and description will not be repeated for them.

Figure 1:
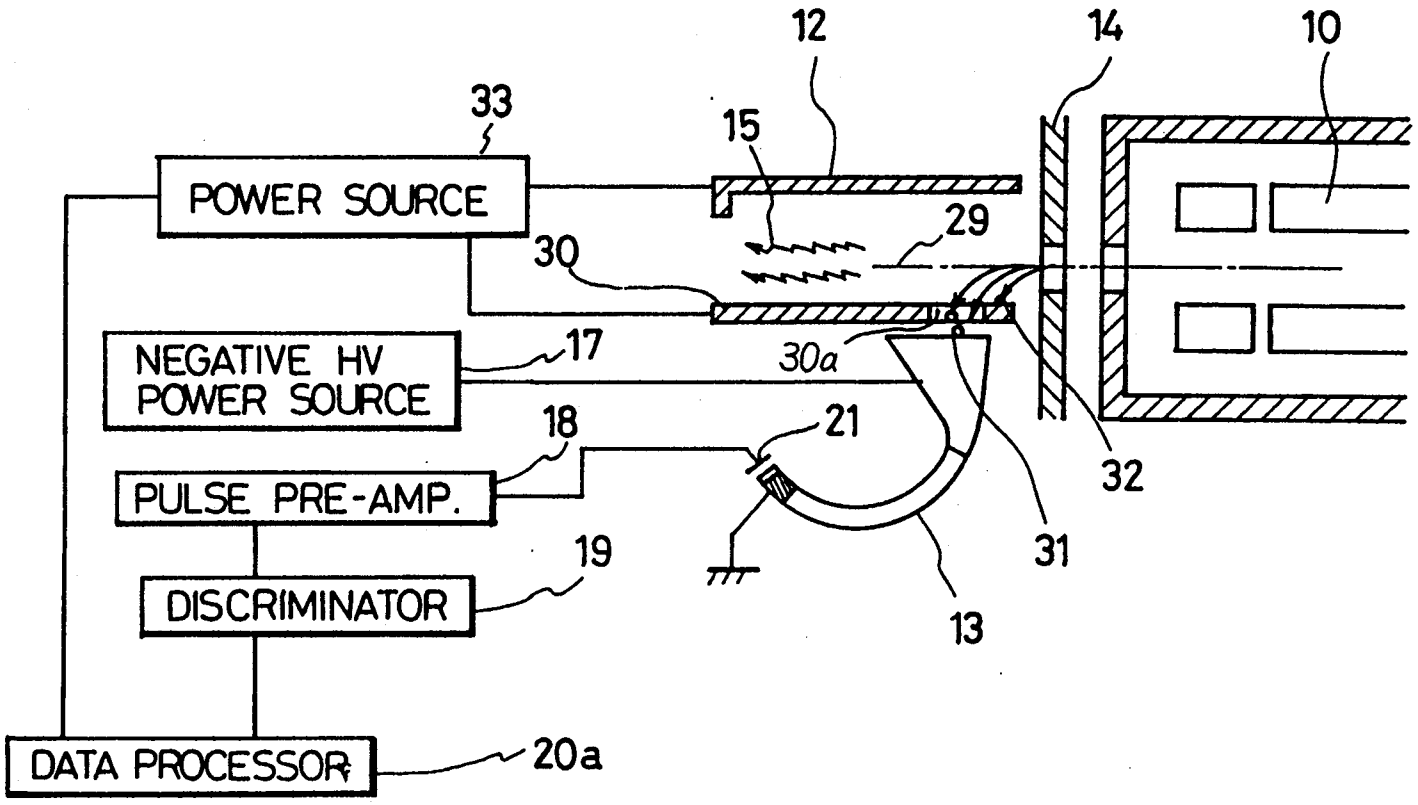
FIG. 1 is a typical configuration diagram showing the configuration of major parts of an embodiment of an induced plasma mass spectrometer according to the present invention.
Figure 2:
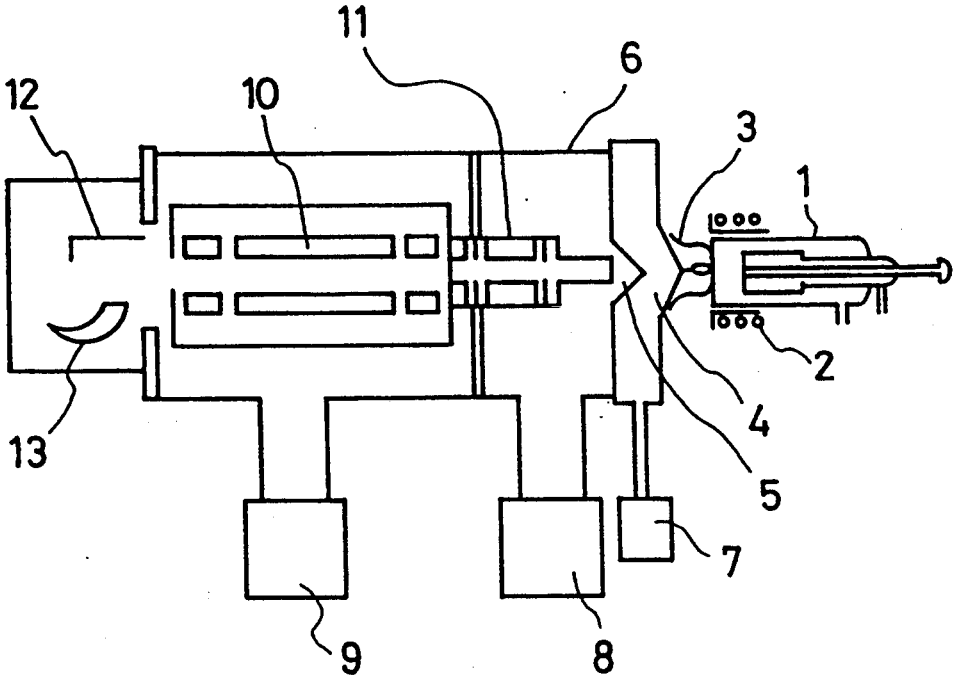
FIG. 2 PRIOR ART
FIG. 2 is a view for explaining a problem in the prior art.

FIG. 1 is a typical configuration diagram showing the configuration of major parts of an embodiment of the inductive plasma mass spectrometer according to the present invention. The configuration of a plasma generating portion, vacuum chamber, sampling cone, skinner cone, evacuator and the like not shown in FIG. 1 is similar to that of the prior art shown in FIG. 2 and description on such will therefore be omitted.

Figure 3:
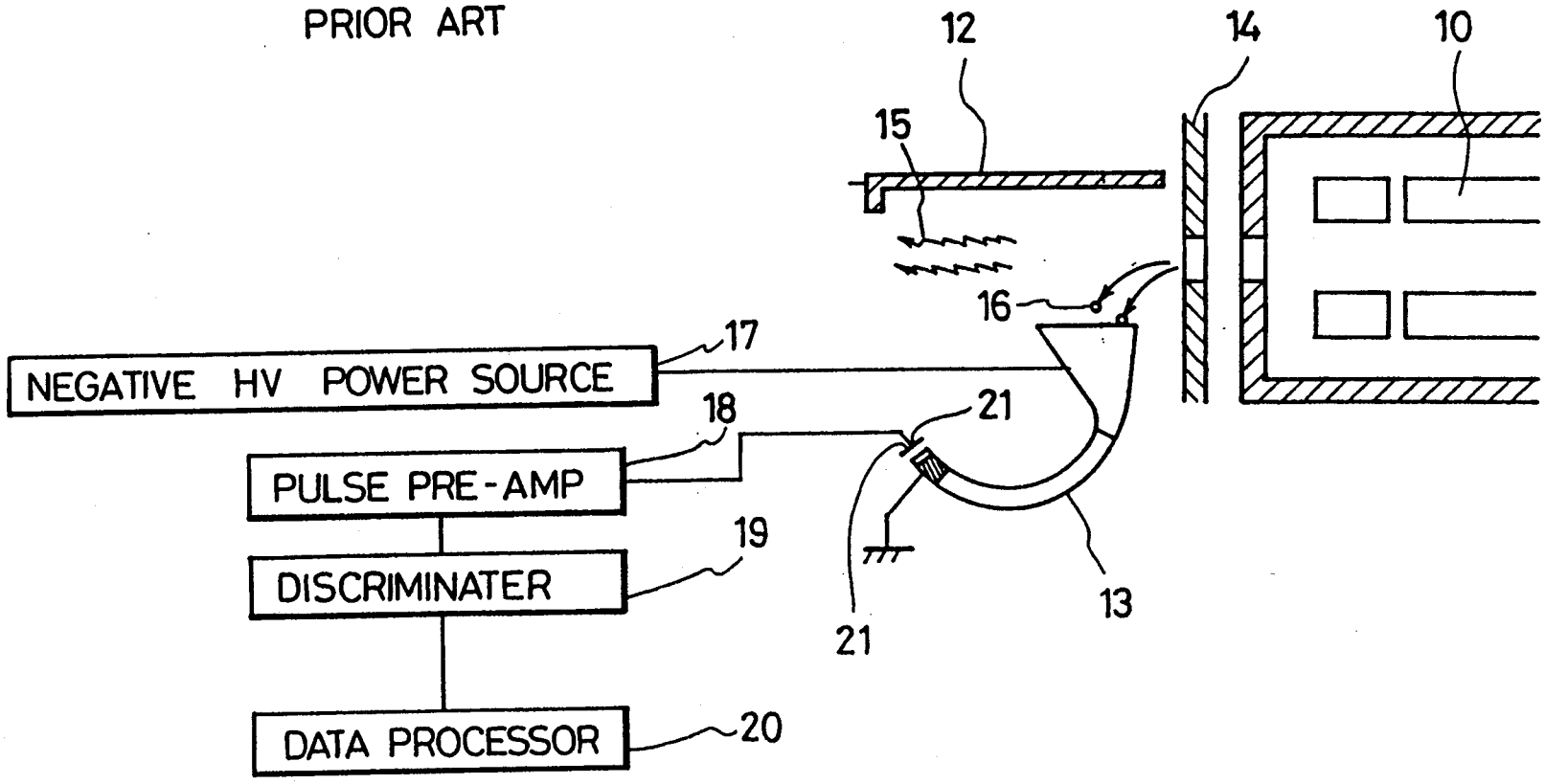
FIG. 3 PRIOR ART
FIG. 3 is a view for explaining a problem in the prior art.
Figure 4:
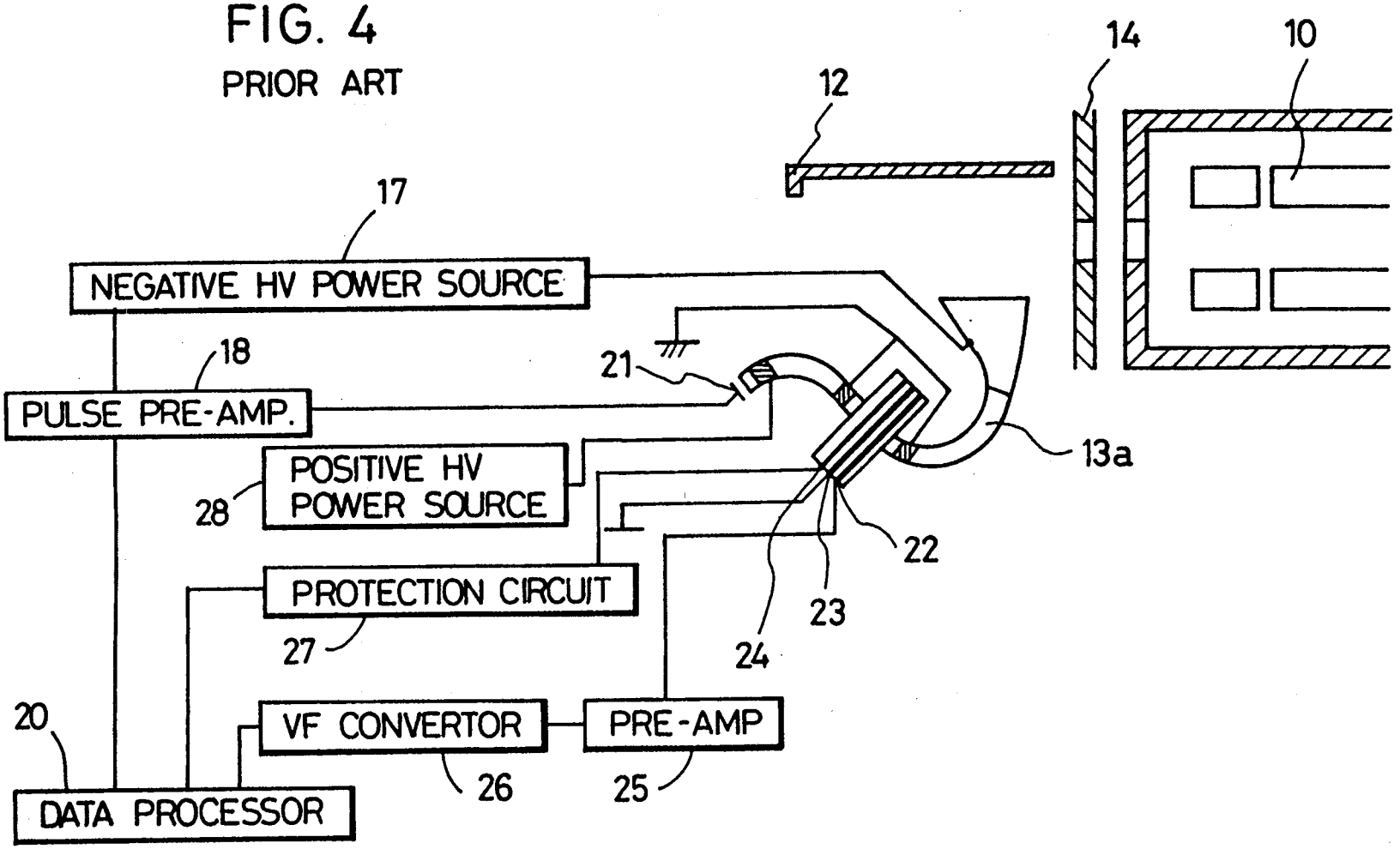
FIG. 4 PRIOR ART
FIG. 4 is a view for explaining a problem in the prior art.

Further, a mass filter 10, repeller electrode 12, detector 13, extraction electrode 14, high voltage power source 17, pulse pre-amplifier 18, discriminator 19, and output terminal 21 in FIG. 1 are similar to those in the prior art shown in FIG. 3, so description on the function of such will be omitted.

The ions which have reached the exit of the mass filter 10 are extracted from the mass filter 10 by the extraction electrode 14 and are accelerated. 29 designates the axis of the mass filter which indicates the central axis of the mass filter 10. The repeller electrode 12 and the detector 13 are disposed on opposite sides about the axis 29 of the mass filter. This allows only the ions which have passed through the mass filter 10 to reach the detector 13 and disallows light 15 acting as a background noise to reach the detector 13.

The ions which have passed through the mass filter 10 include signal ions to be detected and background ions. The signal ions are the ions of minor impurities in the sample produced in the inductive plasma 3 shown in FIG. 2 and are generated to have energy corresponding to the plasma electric potential of the inductive plasma 3. On the other hand, the background ions are produced as a result of a collision between ions and residual gas and the like in the mass filter 10 and have energy close to 0 when produced.

In FIG. 1, 30 designates an assist electrode; 31 designates the signal ions; 32 designates the background ions; and 33 designates a power source. The assist electrode 30 is an electrode disposed between the axis 29 of the mass filter and the detector 13. It has a structure having a hole **30*a* allowing the signal ions 31 which have exited the mass filter 10 to pass therethrough to reach the detector 13**.

The size of the hole **30*a* of the assist electrode 30 is appropriate if it is similar to that of an opening for detecting ions on the detector 13, i.e., on the order of 8 to 20 mm in diameter. Voltage is applied by the power source 33 to the repeller electrode 12 and the assist electrode 30. The presence of the assist electrode 30 suppresses an electric field produced by the detector 13 in the space surrounded by the repeller electrode 12, the extraction electrode 14, and the assist electrode 30**.

This makes it possible to control the course of the ions which have passed through the mass filter 13 by an electric field produced by the repeller electrode 12 and the assist electrode 30.

When the minor impurities in the sample to be measured are in the range of low and intermediate concentrations [The quantity of the signal ions is about 10 pieces per second or less which corresponds to about 100 ppb (1/10) or less], voltage is applied to the repeller electrode 12 and the assist electrode 30 so that the signal ions which have passed through the mass filter 10 efficiently pass through the hole **30*a* in the assist electrode 30 to be detected by the detector 13**.

The voltage at this time depends on the arrangement of the electrodes and the detector and the like. For example, a voltage of about +50 V and a voltage of about −50 V are applied to the repeller electrode 12 and the assist electrode 30, respectively (This is for detection of positive ions, and the polarities are reversed for detection of negative ions.). Thus, for the detection of positive ions, the assist electrode is supplied a negative voltage and the repeller electrode is supplied a positive voltage. Further, when the minor impurities in the sample to be measured are in the range of intermediate and high concentrations [The quantity of the signal ions passing through the master filter 10 is about 103 to 109 pieces per second which corresponds to about 100 ppt (1/10) to 100 ppm (1/10)], voltage is applied to the repeller electrode 12 and the assist electrode 30 so that a part (e.g., about 1/1000) of the signal ions which have passed through the mass filter 10 pass through the hole **30*a* in the assist electrode 30 to be detected by the detector 13**.

The difference in electric potential between the repeller electrode 12 and the assist electrode 30 is set in two ways, i.e. setting it either greater or smaller than the difference in electric potential set for measurement at low concentrations. However, if it is set smaller than the difference in electric potential set for the measurement at low concentrations, the quantity in which the ions are polarized between the repeller electrode 12 and the assist electrode 30 becomes small. As a result, the background ions 32 which have been generated with energy closer to 0 than that of the signal ions 31 and hence is more easily polarized will reach the detector 13 in a greater ratio, raising the level of the background noises. On the contrary, if it is set greater than the difference in electric potential set for measurement at low concentrations, there will be no increase in the background noise level.

Therefore, in measuring minor impurities in intermediate and high concentrations, it is possible to control the quantity of the signal ions reaching the detector 13 and to perform measurement free from background noises by setting the difference in electric potential between the repeller electrode 12 and the assist electrode 30 greater than the difference in electric potential for measurement at low concentrations. The voltage applied at this time is, for example, about +300 V for the repeller electrode 12 and about −50 V for the assist electrode 30 (This is for detection of positive ions and the polarities are reversed for detection of negative ions.). In other words, the absolute value of the voltage supplied to the repeller electrode is bigger than that supplied to the assist electrode.

20*a* designates a data processor. In addition to its function in the prior art of performing quantitative and qualitative analysis on minor impurities in a sample based on the count of the pulses from the discriminator 19 and the setting of the mass filter 10, the data processor 20*a* manages the counting rate of the pulses from the discriminator 19 to send a signal indicating the set voltage of the repeller electrode 12 or the assist electrode 30 to the power source 33. In accordance with the signal from the data processor 20*a*, the power source 33 applies voltage to the repeller electrode 12 and the assist electrode 30.

In the case of intermediate impurity concentrations wherein the quantity of the signal ions passing through the mass filter 10 is 103 to 106 pieces per second, it is needless to say that analysis is possible with the voltage of the repeller electrode 12 and the assist electrode 30 set for measurement at either low or high concentrations.

As will be apparent from the above description, in the present embodiment, detection can be performed using the ion count method even when the minor impurities to be measured are in intermediate or high concentrations.

Although the present invention has been specifically described with reference to an embodiment thereof, it is needless to say that the present invention is not limited to the embodiment and various modifications may be made to an extent which does not depart from the principles thereof.

As described above, the present invention makes it possible to control the quantity of ions incident on a detector. This eliminates the possibility of deterioration of the detector due to excessive ions incident on the detector even if the concentration of the impurities to be measured in a sample is high. Further, since detection is performed using the ion count method even when the concentration of the impurities to be measured in a sample is high, it is possible to measure a concentration range of effective figures in about six digits under the conditions for measurement at high concentrations. In addition, since detection is performed using the ion count method regardless of the concentration of the impurities to be measured in a sample, it is possible to provide a detection system which is less expensive than the prior art.

What is claimed is:

1. An inductive plasma mass spectrometer comprising: a plasma generating portion for inductively converting a sample into plasma; a sampling cone and a skimmer cone having small holes at the forward ends thereof for introducing said sample which has been ionized by said plasma generating portion into a vacuum chamber; a mass filter which allows ions having a specified mass to pass therethrough from among ions of said sample; an ion lens for leading the ions of said sample which have passed through said skimmer cone to said mass filter; a detector for detecting the ions which have passed through said mass filter; a repeller electrode disposed at the exit of said mass filter on the side opposite to said detector about the central axis of said mass filter; and an evacuator for evacuating said mass filter, said ion lens, said detector and said repeller electrode in said vacuum chamber characterized in that an assist electrode having a hole for leading ions of minor impurities in said sample which have passed through said mass filter to said detector is provided between the axis of said mass filter and said detector and a means for applying voltage to said repeller electrode and said assist electrode.

2. An inductive plasma mass spectrometer as claimed in claim 1, wherein said assist electrode is supplied opposite voltage against that of the repeller electrode.

3. An inductive plasma mass spectrometer as claimed in claim 1, wherein the absolute value of the voltage supplied to said repeller electrode is bigger than that supplied to the assist electrode.

4. An inductive plasma mass spectrometer as claimed in claim 1, wherein said assist electrode is supplied a negative voltage and said repeller electrode is supplied a positive voltage.

5. An inductive plasma mass spectrometer as claimed in claim 1, wherein said hole of the assist electrode is provided at the opposite side of the detector.

* * * * *